US005122835A

United States Patent [19]

Rushing et al.

[11] Patent Number: 5,122,835

[45] Date of Patent: Jun. 16, 1992

[54] COMPENSATING DENSITOMETER READINGS FOR DRIFTS AND DUSTING

[75] Inventors: Allen J. Rushing, Webster; Sally L. Stearns, North Chili; David D. Almeter, Rochester, all of N.Y.

[73] Assignee: Eastman Kodak Company, Rochester, N.Y.

[21] Appl. No.: 696,381

[22] Filed: May 6, 1991

[51] Int. Cl.[5] ..... G03G 21/00

[52] U.S. Cl. ..... 355/208; 355/246

[58] Field of Search ..... 355/203, 204, 208, 214, 355/246, 326–328

[56] References Cited

U.S. PATENT DOCUMENTS

| | | | |
|---|---|---|---|
| 4,183,657 | 1/1980 | Ernst et al. | 355/208 |
| 4,313,671 | 2/1982 | Kuru | 355/246 X |
| 4,326,795 | 4/1982 | Tajima et al. | 355/246 |
| 4,341,461 | 7/1982 | Fantozzi | 355/246 |
| 4,377,338 | 3/1983 | Ernst | 355/246 |
| 4,647,184 | 3/1987 | Russell et al. | 355/208 |
| 4,693,592 | 9/1987 | Kurpan | 355/208 |
| 4,860,059 | 8/1989 | Terashita | 355/38 |
| 4,878,082 | 10/1989 | Matsushita et al. | 355/208 |
| 4,894,685 | 1/1990 | Shoji | 355/246 |
| 5,051,781 | 9/1991 | Roehrs et al. | 355/208 |

*Primary Examiner*—A. T. Grimley
*Assistant Examiner*—William J. Royer
*Attorney, Agent, or Firm*—David A. Howley

[57] ABSTRACT

Densitometer readings are corrected by obtaining density readings on an untoned area of the interframe region of an image receiver during cycle-up, storing the readings and subtracting the stored readings from subsequent test readings of the same area of the image receiver. Differences between the cycle-up readings and test readings are used to adjust density readings of toned reference patches obtained with the test readings. The procedure can be used during production modes of the machine, with all readings being taken in the interframe regions, or the procedure can be a part of an automatic set-up operation with toned reference patch readings being taken in the image frame areas of the image receiver.

11 Claims, 3 Drawing Sheets

COMPENSATING DENSITOMETER READINGS FOR DRIFTS AND DUSTING

CROSS REFERENCE TO RELATED APPLICATION

Reference is made to commonly assigned, copending U.S. patent application Ser. No. 678,395 entitled NORMALIZING AIM VALUES DENSITY AND PATCH READING FOR AUTOMATIC SET-UP IN ELECTROSTATOGRAPHIC MACHINES and filed on Apr. 1, 1991 in the name of A. Rushing.

BACKGROUND OF THE INVENTION

1. Field of the Invention

The invention relates to electrostatographic document production machines, and more particularly to automatic adjustment of parameters influencing the output reproduction of such machines.

2. Description of the Prior Art

In electrostatographic document production machines such as printers and copiers, image contrast, density, and color balance (in color machines) can be adjusted by changing certain process control parameters such as primary voltage $V_0$, exposure $E_0$, development station electrode bias voltage $V_b$, the concentration of toner in the developer mixture, and the image transfer potential.

Control of such parameters is often based on measurements of the density of a toner image in a test patch. However, errors caused by densitometer drift due to environmental conditions have plagued the industry. For example, operating characteristic instability (drift) with temperature changes and/or contamination (dusting) by toner particles will greatly affect the accuracy of a densitometer.

U.S. Pat. No. 4,313,671, which issued to H. Kuru on Feb. 2, 1982, addresses the problem of errors caused by environmental conditions. In Kuru, an untoned area in the interframe region of a photoconductive member is compared to a toned reference patch, the difference being an indication of the toning characteristic of the machine. In a first embodiment, different sensors are used for the toned and untoned areas. This has all the disadvantages of two sensors, including initial cost, the need to compensate for inequality in the sensitivity and linearity of the individual sensors, the assumption that both sensors are exposed to same temperature changes and contamination, and the requirement that both sensors react equally to changes in environment.

In a second embodiment, Kuru uses a single sensor to first scan an untoned area and then a toned reference patch in the same interframe region of the photoconductive member. The output of the sensor as it scans the untoned area is compared to a reference value. Any detected error is fed back to adjust the quantity of light illuminating the photoconductive member to correct for sensor variation. While this configuration overcomes the disadvantages of the embodiment having two sensors, it requires a series of iterations of sensing the untoned region, comparing the signal to a reference, adjusting the illumination, resensing the untoned area, and so on until the reading matches the reference value. Since the photoconductive member is moving during this process, the interframe region must be quite large or the system must be satisfied with incompleted adjustments.

U.S. Pat. No. 4,183,657, which issued to L. Ernst et al. on Jan. 15, 1980, provides a toner concentration test by sensing an untoned area and a toned reference patch in the image frame area of a photoconductive member. A reference voltage obtained by illuminating the untoned area with a low intensity, and a sample voltage is obtained by illuminating the toned reference patch with a greater intensity to compensate for the difference in reflectivity of the two regions. By keeping the amount of light reaching the sensor equal, non-linearities in the sensor response do not interfere with accuracy.

However, Ernst et al. are not without problems. The condition of the image receiver will unequally affect the density readings of the untoned area and the toned reference patch. For example, the untoned area density readings may be greatly affected by the amount of wear of the photoconductive member, the existence of scumming, and the presence of photoconductor fatigue. These variables are greatly increased when the patch is in a portion of the image receiver which is repeatedly toned and erased, such as in an image frame area; and non-uniformities in the amount of wear and scumming from one part of the photoconductive member to another may further degrade the system. Ernst et al. also shares with Kuru the disadvantage of requiring several iterations of sensing the untoned area, adjusting the process, and repeating the operation until the readings are within specification.

DISCLOSURE OF INVENTION

It is an object of the present invention to provide for accurately determining test patch densities regardless of sensor drift, dusting, image receiver wear, scumming, and fatigue.

According to one feature of the present invention densitometer readings are corrected by obtaining density readings on an untoned area of the interframe region of an image receiver during cycle-up, storing the readings and subtracting the stored readings from subsequent test readings of the same area of the image receiver. Differences between the cycle-up readings and test readings are used to adjust normalized density readings of toned reference patches obtained with the test readings.

The procedure can be used during production modes of the machine, with all readings being taken in the interframe regions, or the procedure can be a part of an automatic set-up operation with toned reference patch readings being taken in the image frame areas of the image receiver.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present invention is described below in the environment of an electrophotographic copier. At the outset, it will be noted that although this invention is suitable for use with such machines, it also can be used with other types of electrostatographic copiers or printers.

For a detailed explanation of the theory of copier contrast and exposure control by changing various process control parameters, reference may be made to the following article: Paxton, Electrophotographic Systems Solid Area Response Model, 22 Photographic Science and Engineering 150 (May/Jun. 1978).

Figure 1:
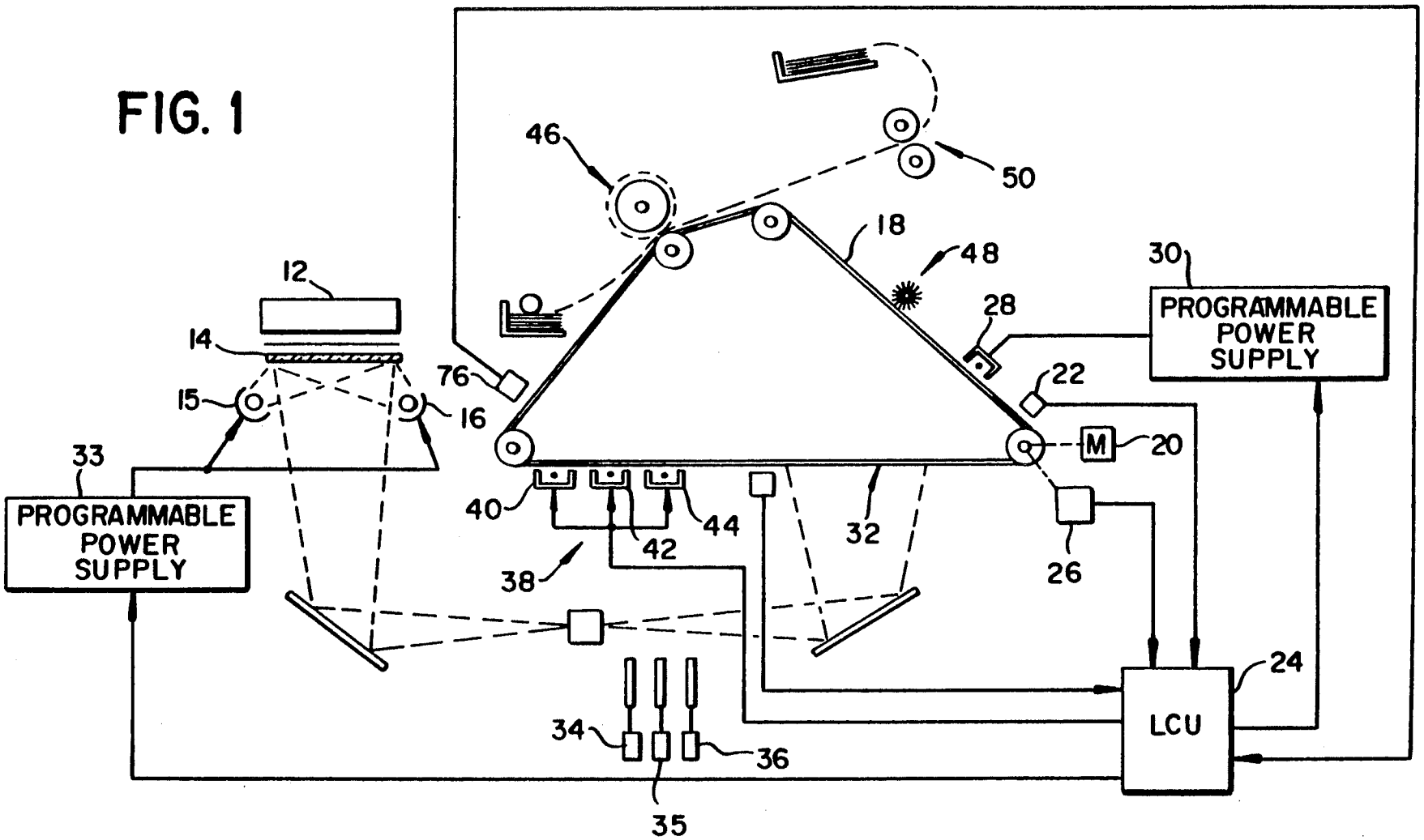
FIG. 1 is a schematic showing a side elevational view of an electrostatographic machine in which the invention is useful.

Referring to FIG. 1, a three-color copier includes a recirculating feeder 12 positioned on top of an exposure platen 14 and xenon flashlamps 15 and 16. An image of the illuminated original is optically projected onto one of a plurality of sequentially spaced, non-overlapping image frame areas of a moving image receiver such as photoconductive belt 18.

Photoconductive belt 18 is driven by a motor 20 past a series of work stations of the copier. A microprocessor within a logic and control unit 24 has a stored program responsive to signals from a generator 22 and an encoder 26 for sequentially actuating the work stations.

For a complete description of the work stations, see commonly assigned U.S. Pat. No. 3,914,046. Briefly, a charging station 28 applies an electrostatic charge of predetermined initial voltage $V_0$ to the surface of the belt as controlled by a programmable power supply 30, which is in turn controlled by LCU 24.

The inverse image of the original is projected onto the charged surface of photoconductive belt 18 at an exposure station 32. The image dissipates the electrostatic charge and forms a latent charge image A programmable power supply 33, under the supervision of LCU 24, controls the intensity and/or duration of light produced by lamps 15 and 16. This, of course, adjusts the exposure of belt 18, and thereby the voltage of the photoconductor Just after exposure. For a specific example of such an exposure station and programmable power supply, see U.S. Pat. No. 4,150,324, issued Aug. 8, 1978.

The illustrated copier is adapted to reproduce three-color copies. The original is illuminated, for example, three times in succession to form three separate latent charge image frames of the original. On successive illuminations, a red filter 34, a green filter 35, or a blue filter 36 is inserted into the light path to form color separation latent charge images at exposure station 32. As understood in the art, provision may be made for a fourth exposure for areas to be developed in black, if desired.

Travel of belt 18 brings the areas bearing the latent charge images into a magnetic brush development area 38. Magnetic brush development stations 40, 42 and 44 are well known; for example, see U.S. Pat. No. 4,473,029 to Fritz et al and U.S. Pat. No. 4,546,060 to Miskinis et al. Conductive portions of the development station act as electrodes, and are electrically connected to a variable supply of D.C. potential controlled by LCU 24 for adjusting the development electrode bias voltage.

The copier also includes a transfer station 46 and a cleaning station 48, both fully described in commonly assigned U S. patent application Ser. No. 809,546, filed Dec. 16, 1985. After transfer of the unfixed toner images to a copy sheet, such sheet is transported to a fuser station 50 where the image is fixed to the sheet.

A densitometer 76 is provided to monitor development of test patches at predetermined positions of photoconductive belt 18. The densitometer may consist of an infrared light emitting diode (LED) which shines through the belt (transmittance) or is reflected by the belt (reflectance) onto a photodiode. The photodiode generates a voltage proportional to the amount of light transmitted or reflected from a toned patch.

Figure 2:
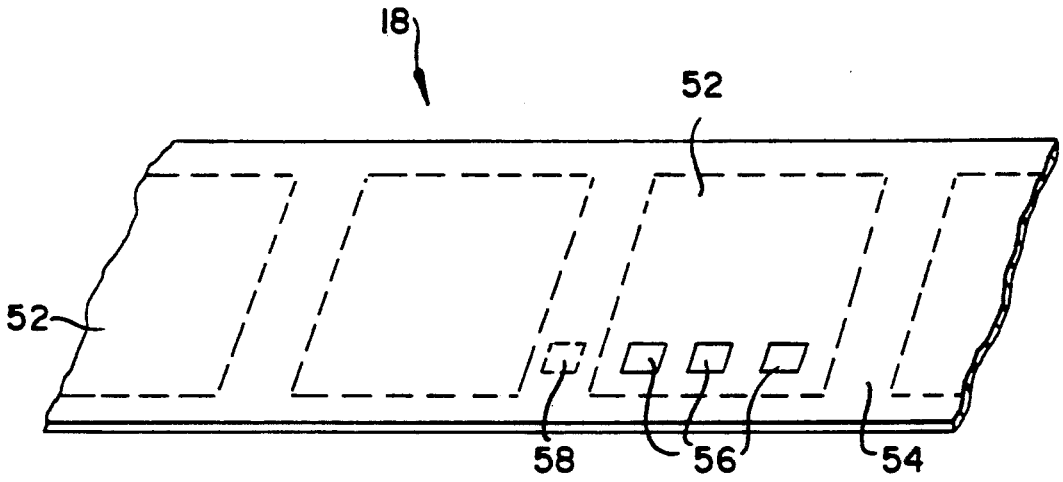
FIG. 2 is and enlarged fragmentary view of a portion of the image receiver of the machine shown in FIG. 1.

Referring to FIG. 2, a fragmentary view of a portion of photoconductive belt 18 is illustrated with a plurality of image frame areas 52 spaced slightly apart from each other along the longitudinal length of the belt; thus defining non-image interframe regions 54. In order to control the electrographic process, it is known to provide one or more toned reference patches 56 in either interframe regions 54, in frame areas 52 as illustrated, or in the cross-track margin region laterally outside of the image frame areas. By way of example, three toned reference patches 56 are shown. When multiple reference patches are used for density measurement, the patches preferably are exposed to obtain different density levels of toner so that the electrographic process can be checked and controlled for various operating parameters.

As toned reference patches 56 pass densitometer 76, a signal generated by the densitometer is provided to LCU 24, which is programmed to provide various feedback signals to portions of the apparatus in response to the signal received from the densitometer. For example, the control signal from the densitometer can cause the LCU to regulate a number of process control parameters that effects the density of the toner images on the photoconductive belt.

Ideally, densitometer readings from toned reference patches 56 will be consistent for a given amount of toner on the patch. However, operating characteristic instability (drift) with temperature changes and/or contamination (dusting) by toner particles will greatly affect the accuracy of a densitometer. Accordingly, the present invention provides for accurately determining test patch densities regardless of sensor drift and dusting.

Figure 3:
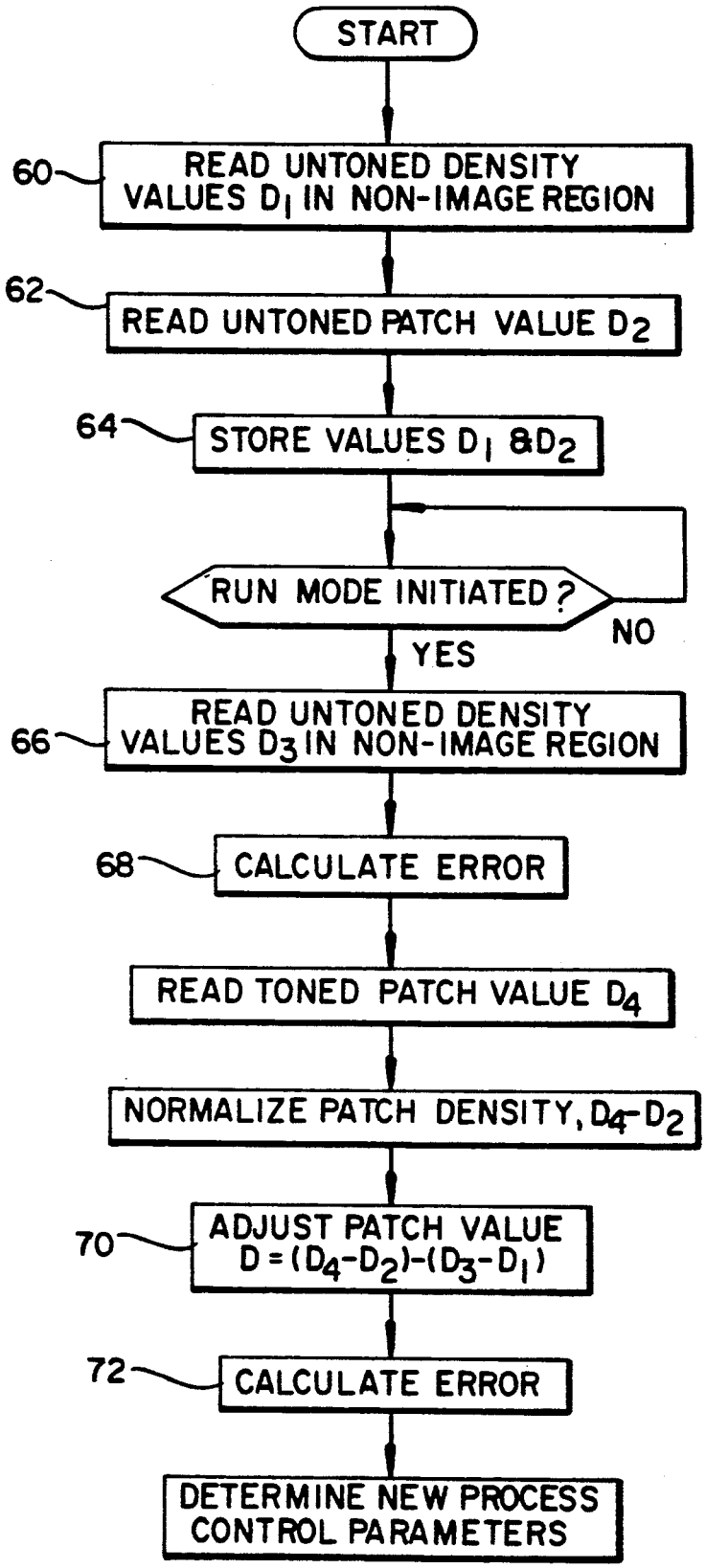
FIG. 3 is a logic flow chart of the operation of the set-up procedure according to the present invention.

Referring also to FIG. 3, the machine begins a cycle-up mode when initiated. During the cycle-up, the machine will warm up if power had been off, and will go through a series of special procedures characteristic of the particular machine before it can be used to produce prints or copies. According to the present invention, one of the procedures will be to scan an untoned area 58 in interframe region 54 (or in some other portion of belt 18 other than in one of image frame areas 52) as indicated by logic step 60. Readings may be taken on both sides of each image frame area, and the average stored for each frame area. During the same pass, the densitometer scans the untoned reference patches 56 in the image frame areas (logic step 62). The densitometer readings obtained during this scan are stored in memory in LCU 24 (logic step 64).

As explained above, the machine may be configured to use density readings from time to time during document production operation to maintain process control parameters, and/or it may use the density readings in a special "set-up" operation as fully described in commonly assigned, copending U.S. patent application Ser. No. 678,395 entitled NORMALIZING AIM VALUES AND DENSITY PATCH READING FOR AUTOMATIC SET-UP IN ELECTROSTATOGRAPHIC MACHINES and filed on Apr. 1, 1991 in the name of A. Rushing; the disclosure of which is incorporated herein by reference. As used herein, the phrase "run mode" is used to refer to either set-up operation or normal operation for producing prints or copies.

When a run mode is initiated, whether for document production operation or for a special set-up operation, the densitometer first scans the untoned area 58 in interframe region 54 (or in some other portion of belt 18 other than in one of image frame areas 52) as shown in logic block 66 of FIG. 3. The densitometer readings thus obtained of the untoned area and patches are compared to the stored value obtained during cycle-up (logic step 68). Any difference between the scanned and stored values is due to densitometer drift or dusting, and is used to correct (logic step 70) the reading from the toned reference patch (normalized by the stored untoned readings of the reference patch) before the corrected reading is compared to an aim value (logic step 72).

The invention has been described in detail with particular reference to preferred embodiments thereof, but it will be understood that variations and modifications can be effected within the spirit and scope of the invention. For example, interframe readings of untoned areas before and after a toned reference patch in the image frame area may be averaged to determine a correction appropriate for the middle of the frame.

What is claimed is.

1. Apparatus for adjusting at least one process control parameter of an electrostatographic machine, having a cycle-up mode and a run mode, in accordance with detected density values from a toned reference patch on an image receiver having image frame areas, said apparatus comprising:

sensor means for (1) sensing the optical density of an untoned area of the image receiver in a region outside of an image frame area and (2) generating, during the run mode, a signal having a value characteristic of the normalized detected optical density of the toned reference patch;

means for correcting the value of the generated signal in accordance with the difference between the sensed optical density of the untoned area of the image receiver during the cycle-up mode and the sensed optical density of the same untoned region during the run mode; and means for comparing the corrected value of the generated signal with an aim value to control the process control parameter.

2. Apparatus as defined in claim 1 wherein said sensor means is adapted to sense the optical density of an untoned area of the image receiver in an interframe region.

3. Apparatus as defined in claim 1 wherein said sensor means is adapted to sense the optical density of a toned reference patch in an image frame area.

4. Apparatus as defined in claim 1 further comprising means for storing said sensed optical density of the untoned area obtained during the cycle-up mode for use during the run mode.

5. Apparatus for adjusting at least one process control parameter of an electrostatographic machine, having a cycle-up mode and a run mode, in accordance with detected density values from a toned reference patch on an image receiver having image frame areas, said apparatus comprising:

sensor means for (1) sensing the optical density of an untoned area of the image receiver in a region outside of an image frame area and (2) generating, during the run mode, a signal having a value characteristic of the detected optical density of the toned reference patch; and means for adjusting the process control parameter in accordance with the difference between the sensed optical density of the untoned area of the image receiver during the cycle-up mode and the sensed optical density of the same untoned region during the run mode.

6. Apparatus as defined in claim 5 wherein said sensor means is adapted to sense the optical density of an untoned area of the image receiver in an interframe region.

7. Apparatus as defined in claim 5 wherein said sensor means is adapted to sense the optical density of a toned reference patch in an image frame area.

8. Apparatus as defined in claim 5 further comprising means for storing said sensed optical density of the untoned area obtained during the cycle-up mode for use during the run mode.

9. A process adjusting at least one process control parmeter of an electrostatographic machine, having a cycle-up mode and a run mode, in accordance with detected density values from a toned reference patch on an image receiver having image frame areas, said process comprising:

sensing the optical density of an untoned area of the image receiver in a region outside of an image frame area generating, during the run mode, a signal having a value characteristic of the detected optical density of the toned reference patch, correcting the value of the generated signal in accordance with the difference between the sensed optical density of the untoned area of the image receiver during the cycle-up mode and the sensed optical density of the same untoned region during the run mode; and comparing the corrected value of the generated signal with an aim value to control the process control parameter.

10. A process as defined in claim 1 further comprising storing said sensed optical density of the untoned area obtained during the cycle-up mode for use during the run mode.

11. A process for adjusting at least one process control parameter of an electrostatographic machine, having a cycle-up mode and a run mode, in accordance with detected density values from a toned reference patch on an image receiver having image frame areas, said process comprising:

sensing the optical density of an untoned area of the image receiver in a region outside of an image frame area;

generating, during the run mode, a signal having a value characteristic of the detected optical density of the toned reference patch, and adjusting the process control parameter in accordance with the difference between the sensed optical density of the untoned area of the image receiver during the cycle-up mode and the sensed optical density of the same untoned region during the run mode.

* * * * *